US010429021B2

(12) United States Patent
Iwasaki

(10) Patent No.: US 10,429,021 B2
(45) Date of Patent: Oct. 1, 2019

(54) VEHICLE LAMP FITTING

(71) Applicant: ICHIKOH INDUSTRIES, LTD., Isehara-shi, Kanagawa-ken (JP)

(72) Inventor: Kazunori Iwasaki, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 510 days.

(21) Appl. No.: 14/899,685

(22) PCT Filed: Jun. 26, 2014

(86) PCT No.: PCT/JP2014/066952
§ 371 (c)(1),
(2) Date: Dec. 18, 2015

(87) PCT Pub. No.: WO2014/208655
PCT Pub. Date: Dec. 31, 2014

(65) Prior Publication Data

US 2016/0146418 A1 May 26, 2016

(30) Foreign Application Priority Data

Jun. 26, 2013 (JP) ..... 2013-134164
Jun. 26, 2013 (JP) ..... 2013-134165

(51) Int. Cl.
*F21S 41/141* (2018.01)
*F21S 41/143* (2018.01)
(Continued)

(52) U.S. Cl.
CPC ..... *F21S 41/141* (2018.01); *F21S 41/143* (2018.01); *F21S 41/255* (2018.01); *F21S 41/26* (2018.01); *F21S 41/265* (2018.01); *F21S 41/27* (2018.01)

(58) Field of Classification Search
CPC ..... F21S 41/27; F21S 41/265; F21S 41/26; F21S 41/143; F21S 41/141; F21S 41/255;
(Continued)

(56) References Cited

U.S. PATENT DOCUMENTS 4,796,171 A * 1/1989 Lindae ..... F21V 5/002 362/308
2005/0190572 A1 9/2005 Komatsu et al.
(Continued)

FOREIGN PATENT DOCUMENTS

EP 2 237 080 A1 10/2010
JP H03-122902 A 5/1991
(Continued)

OTHER PUBLICATIONS

Chinese Office Action dated Aug. 3, 2017 as received in corresponding Chinese Application No. 201480036072.X and its English translation thereof.
(Continued)

*Primary Examiner* — Erin Kryukova
(74) *Attorney, Agent, or Firm* — Foley & Lardner LLP

(57) ABSTRACT

A vehicle lamp fitting comprises a lens and a semiconductor light source. The lens is composed of an incident surface and exit surfaces divided into upper region, middle region, and lower region. The exit surface in the upper region and the exit surface in the lower region emit a first light distribution pattern and a fifth light distribution pattern, respectively, which are symmetrical or substantially symmetrical with respect to a vertical line extending from the top to bottom of a screen.

8 Claims, 15 Drawing Sheets

(51) Int. Cl.

| | |
|---|---|
| ***F21S 41/255*** | (2018.01) |
| ***F21S 41/26*** | (2018.01) |
| ***F21S 41/265*** | (2018.01) |
| ***F21S 41/27*** | (2018.01) |

(58) Field of Classification Search
CPC ..... F21S 41/275; F21S 41/28; F21V 5/002; F21V 5/004; F21V 5/005; F21V 5/045
See application file for complete search history.

(56) References Cited

U.S. PATENT DOCUMENTS

2007/0127253 A1* 6/2007 Kawashima ..... F21S 41/155 362/509
2007/0291499 A1* 12/2007 Tanaka ..... F21S 41/255 362/509
2008/0247188 A1* 10/2008 Woodward ..... G02B 19/0066 362/554
2008/0253141 A1 10/2008 Nakada et al.
2009/0262546 A1* 10/2009 Stefanov ..... F21V 13/04 362/507
2010/0177526 A1* 1/2010 Futami ..... F21S 41/255 362/519
2010/0165652 A1* 7/2010 Ookubo ..... G02B 19/0014 362/522
2012/0057363 A1* 3/2012 Ishida ..... F21S 41/143 362/516
2012/0188781 A1* 7/2012 Futami ..... F21S 41/143 362/516
2013/0021812 A1* 1/2013 Schug ..... F21S 41/143 362/487
2013/0027961 A1* 1/2013 Ugajin ..... F21S 41/143 362/538
2013/0308330 A1* 11/2013 Yagi ..... F21V 5/04 362/522
2014/0092616 A1* 4/2014 Motomura ..... G02B 19/0066
2014/0218939 A1* 8/2014 Hsu ..... F21V 5/045 362/338
2014/0226356 A1* 8/2014 Yagi ..... F21S 48/1275 362/522

FOREIGN PATENT DOCUMENTS

| | | | |
|---|---|---|---|
| JP | 2003-123509 | A | 4/2003 |
| JP | 2005-276806 | A | 10/2005 |
| JP | 2007-294434 | A | 11/2007 |
| JP | 2008-262755 | A | 10/2008 |
| JP | 2008-262876 | A | 10/2008 |
| JP | 2009-129572 | A | 6/2009 |
| JP | 2011-181365 | A | 9/2011 |
| JP | 2011-228196 | A | 11/2011 |
| JP | 2013-026161 | A | 2/2013 |
| JP | 2013-051168 | A | 3/2013 |
| WO | WO-2014/077079 | A1 | 5/2014 |

OTHER PUBLICATIONS

Extended European Search Report dated Jun. 8, 2017 as received in corresponding European Application No. 14816564.0.
Japanese Office Action dated Aug. 15, 2017 as received in corresponding Japanese Application No. 2013-134164 and its English translation thereof.
Japanese Office Action dated Aug. 15, 2017 as received in corresponding Japanese Application No. 2013-134165 and its English translation thereof.
Japanese Office Action dated Mar. 7, 2017 as received in corresponding Japanese Application No. 2013-134164 and its English translation thereof.
Japanese Office Action dated Mar. 7, 2017 as received in corresponding Japanese Application No. 2013-134165 and its English translation thereof.

* cited by examiner (A)

(B)

(A)

(B)

(A)

(B)

VEHICLE LAMP FITTING

TECHNICAL FIELD

The present invention relates to a lens direct type vehicle lamp fitting, which enters light (direct light) from a semiconductor light source into a lens, and emits the incident light as a predetermined light distribution pattern.

BACKGROUND ART

A vehicle lamp fitting of this type is conventional (for example, Patent Literatures 1). Hereinafter, a conventional vehicle lamp fitting will be described.

A conventional vehicle lamp fitting comprises a light-emitting element and a projection lens. An exit surface of a projection lens is comprised of a first refraction surface of a lane side region for forming a lane side horizontal cutoff line, a second refraction surface of an opposite lane side region for forming an opposite lane side horizontal cutoff line, and a third refraction surface of between the first refraction surface and the second refraction surface for forming an oblique cutoff line. A low beam is emitted by actuating a light-emitting element.

CITATION LIST

Patent Literatures

Patent Literature 1: JP-A-2011-228196

SUMMARY OF THE INVENTION

Problems to be Solved by the Invention

In such a vehicle lamp fitting, for reducing the manufacturing cost, it is important that the same projection lens can be used in a projection lens of a left side lamp fitting mounted on the left side of a vehicle and a projection lens of a right side lamp fitting mounted on the right side of a vehicle.

A problem to be solved by the present invention is that the same lens can be commonly used for left and right lamp fittings.

Means for Solving the Problem

In an aspect of present invention, a vehicle lamp fitting, comprising a lens and a semiconductor light source, the lens comprises an incident surface, and an exit surface that is divided into an upper region, a middle region, and a lower region, a focal point of the exit surface in the upper region and the exit surface of the lower region is located at the center or substantially the center of a light emission surface of the semiconductor light source, and the exit surface in the upper region and the exit surface of the lower region comprised of one surface, and emit a diffused light distribution pattern.

In an other aspect of the present invention, the exit surface in the middle region is, in a front view, divided by a plurality of, at least two, vertical division lines substantially equal distance to the left and right from the center of the semiconductor light source.

In an other aspect of the present invention, a left and right ends of the exit surface in the middle region are, in a front view, substantially equal distance from the center of the semiconductor light source.

In an other aspect of the present invention, the exit surface in the middle region is divided from left to right into three portions, an opposite lane side, a center, and a driving lane side, the exit surface on the opposite lane side of the middle region emits an opposite lane side diffused light distribution pattern, the exit surface in the center of the middle region emits a central condensed light distribution pattern, and the exit surface on the driving lane side of the middle region emits a driving lane side diffused light distribution pattern.

In an other aspect of the present invention, the center of the light emission surface of the semiconductor light source is located on a reference optical axis or in the vicinity thereof.

In an other aspect of the present invention, the lens is provided in a part of the incident surface, and is further provided with a light diffusing unit for diffusing a part of light distribution of the light distribution pattern.

In an other aspect of the present invention, a vehicle lamp fitting, comprising a lens and a semiconductor light source, the lens comprises: an incident surface for entering light from the semiconductor light source into the lens, an exit surface for emitting the incident light entered from the incident surface to the outside from the lens as a predetermined light distribution pattern, and a light diffusing unit that is provided in a part of the incident surface, and diffuses a part of light distribution of the light distribution pattern.

In an other aspect of the present invention, the exit surface is divided into a plurality of parts, and the light diffusing unit is provided in a range corresponding to the divided exit surface of the incident surface.

In an other aspect of the present invention, the light distribution pattern is a low beam light distribution pattern, and the light diffusing unit is provided in the incident surface, that is, on a horizontal line passing through a reference optical axis or in the vicinity thereof, in a part of an opposite lane side, and is configured to diffuse at least a part of the light distribution pattern having a cutoff line on the opposite lane side of the low beam light distribution pattern, in a vertical direction or substantially vertical direction.

In an other aspect of the present invention, the light diffusing unit is provided in a part of the lower side of the incident surface, and is configured to diffuse at least a part of the lower side of the light distribution pattern in vertical and horizontal directions or substantially vertical and horizontal directions.

Effects of Invention

In the vehicle lamp fitting of the present invention, a lens exit surface is divided into upper region, middle region, and lower region. Focal points of the exit surfaces in the upper region and lower regions are each located at or near the center of a light emission surface of a semiconductor light source. As a result, the exit surfaces in the upper region and lower region are able to emit a diffused light distribution pattern symmetrical or substantially symmetrical with respect to a vertical line extending from the top to bottom of a screen. Thus, it is possible to make the curved surface of the exit surfaces in the upper region and the lower region as a curved surface symmetrical or substantially symmetrical with respect to a vertical or substantially vertical line passing through a reference optical axis. Therefore, the same lens can be commonly used for the right and left lamp fittings.

The vehicle lamp fitting of the present invention is capable of arbitrarily diffusing a part of a light distribution pattern by a light diffusing unit provided in a part of a lens incident surface.

MODES FOR CARRYING OUT THE INVENTION

First Embodiment

Figure 1:
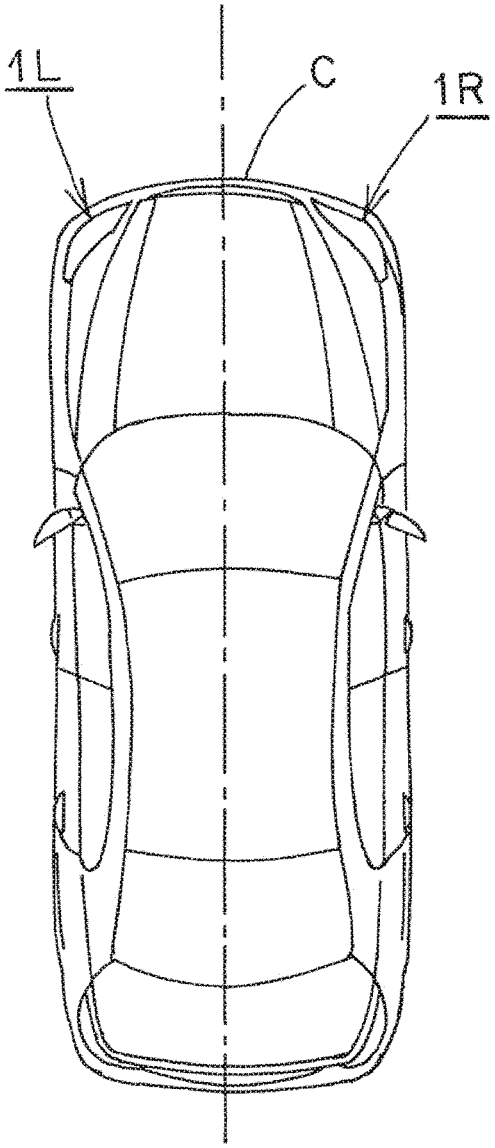
FIG. 1 is a plan view of a vehicle equipped with a vehicle lamp fitting according to a first embodiment of the invention.
Figure 2:
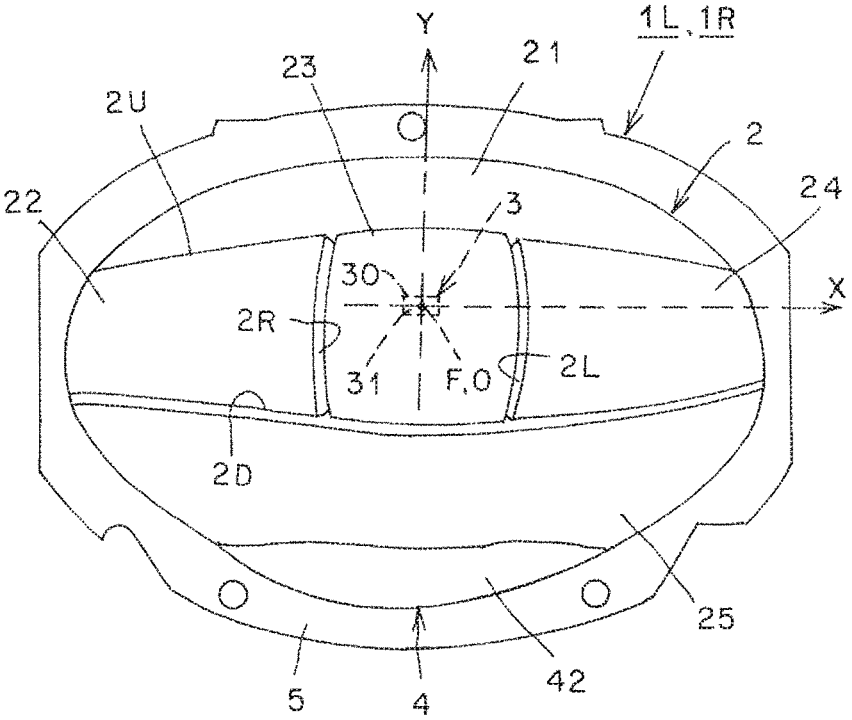
FIG. 2 is a front view showing a lamp unit (lens).

Hereinafter, an embodiment (example) of the vehicle lamp fitting according to the present invention will be described in detail with reference to the drawings. The invention is not to be limited by this embodiment. In FIGS. 5 to 7 and FIGS. 10 and 11, a symbol "VU-VD" represents a vertical line extending from the top to bottom of a screen. A symbol "HL-HR" represents a horizontal ling extending from the left to right of a screen. In this specification, front, back, top, bottom, left, right are front, back, top, bottom, left, right when a vehicle lamp fitting according to the present invention is mounted on a vehicle. In the drawings, in the cross-sectional view of a lens, a hatching is omitted to clarify the optical path.

Description of Configuration of the Embodiment

Hereinafter, a configuration of the vehicle lamp fitting according to this embodiment will be described. In the drawings, a symbol 1L, 1R represents a vehicle lamp fitting according to this embodiment (for example, a vehicle headlight, a low beam headlamp). The vehicle lamp fitting 1L, 1R is mounted on the left and right ends of the front of a vehicle C. The vehicle lamp fitting 1L, 1R is a vehicle lamp fitting for left-hand traffic. Therefore, a driving lane side is left, and an opposite lane side is right.

(Description of Lamp Unit)

The vehicle lamp fitting 1L, 1R comprises a lamp housing (not shown), a lamp lens (not shown), a lens 2, a semiconductor light source 3, a heat sink member (not shown), and a not-shown mounting member (holder, lens holder, or the like).

The lens 2, the semiconductor light source 3, the heat sink member, and the mounting member configure a lamp unit. The lamp housing and the lamp lens define a lamp chamber (not shown). The lamp unit is disposed in the lamp chamber, and is attached to the lamp housing via a vertical direction optical axis adjustment mechanism (not shown) and a horizontal direction optical axis adjustment mechanism (not shown). The lamp chamber may include a lamp unit other than the lamp unit, for example, a fog lamp, a high beam headlamp, a low beam headlamp, a turn signal lamp, a clearance lamp, a daytime running lamp, and a cornering lamp.

(Description of Semiconductor Light Source 3)

The semiconductor light source 3 is, as shown in FIG. 2 to FIG. 9, a self-emitting semiconductor light source such as an LED, OEL, or OLED (organic EL). The semiconductor light source 3 is comprised of a package (LED package) that is formed by sealing a light-emitting chip (LED chip) 30 with a sealing resin member. The package is mounted on a substrate (not shown). A current from a power supply (battery) is supplied to the light-emitting chip 30 via a connector (not shown) attached to the substrate. The heat sink member is attached to the semiconductor light source 3.

The light-emitting chip 30 is formed in a flat square shape (flat rectangular shape). In other words, four square chips are arranged in the X-axis direction (horizontal direction). Two, three, five or more square chips may be used. One rectangular chip or one square chip may be used. The front of the light-emitting chip 30, a rectangular front in this example, forms a light emission surface 31. The light emission surface 31 is faced to the forward of a reference optical axis Z (a reference optical axis of the vehicle lamp fitting 1L, 1R, a reference optical axis of the lens 2, a reference axis). The center O of the light emission surface 31 of the light-emitting chip 30 is located at a reference focus F of the lens 2 or in the vicinity thereof, and is located on or near the reference optical axis Z.

Figure 3:
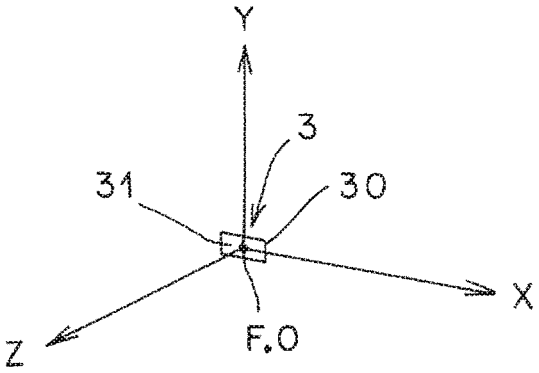
FIG. 3 is a perspective view showing a semiconductor light source.

In FIG. 3, X, Y, Z constitute an orthogonal coordinate (X-Y-Z orthogonal coordinate system). The X-axis is a horizontal axis in a lateral direction passing through the center O of the light emission surface 31 of the light-emitting chip 30. In this embodiment, the left side is a +direction, and the right side is a −direction. The Y-axis is a vertical axis in a perpendicular direction passing through the center O of the light emission surface 31 of the light-emitting chip 30. In this embodiment, the upper side is a +direction, and the lower side is a −direction. Further, the Z-axis is a normal (perpendicular) line passing through the center O of the light emission surface 31 of the light-emitting chip 30, that is, an axis in the longitudinal direction (the reference optical axis Z) orthogonal to the X-axis and Y-axis. In this embodiment, the front side is a +direction, and the rear side is a −direction.

(Description of Lens 2)

The lens 2 is, as shown in FIG. 2, FIGS. 4 to 8, FIGS. 13, 14, comprised of an incident surface 20, a plurality of exit surfaces, five in this example, that is, a first exit surface 21, a second exit surface 22, a third exit surface 23, a fourth exit surface 24, and a fifth exit surface 25 (hereinafter referred to as "exit surface 21 to 25"). The lens 2 is attached to the heat sink member via the mounting member so as to face the semiconductor light source 3. In this example, the center (not shown) of the lens 2 is located below the center O (the X-axis, the reference optical axis Z) of the light emission surface 31 of the light-emitting chip 30. The center of the lens 2 may coincide or substantially coincide with the center O of the light emission surface 31 of the light-emitting chip 30. The center of the lens 2 may be located above the center O of the light emission surface 31 of the light-emitting chip 30.

(Description of Incident Surface 20)

The incident surface 20 is faced to the semiconductor light source 3, and is continuously formed by a quadratic surface or a complex quadratic surface or a free-form surface in this example. The incident surface 20 enters light (direct light) from the semiconductor light source 3 into the lens 2.

(Description of Exit Surface 21 to 25)

The exit surface 21 to 25 is opposite to a surface facing the semiconductor light source 3, and is independently formed by a free-form surface or a complex quadratic surface or a quadratic surface in this example. The entire exit surface 21 to 25 is divided into upper region, middle region, and lower region by two horizontal division step surfaces 2U and 2D. The middle region is divided into a left side (driving lane side), a center, and a right side (opposite lane side) by two vertical division step surfaces 2L and 2R. In other words, the exit surface is divided into a total of five regions.

The entire exit surface 21 to 25 is divided into upper region, middle region, and lower region by two horizontal division step surfaces (lateral division line) 2U and 2D. The middle region is divided into a left side (driving lane side), a center, and a right side (opposite lane side) by two vertical division step surfaces (vertical division line) 2L and 2R. In other words, the exit surface 22, 23, 24 in the middle region is, in a front view (see FIG. 2), divided into three portions by two vertical division step surfaces (longitudinal division line) 2L and 2R located at positions of almost the same distance from the center O of the semiconductor light source 3 (the center O of the light emission surface 31 of the light-emitting chip 30). Therefore, the exit surface 21 to 25 is divided into a total of five regions.

The exit surface 21 in the upper region is recessed rearward from the exit surface 22, 23, 24 in the middle region. The exit surface 22, 23 24 in the middle region is recessed rearward from the exit surface 25 in the lower region. The center exit surface 23 in the center of the middle region is recessed rearward from the exit surfaces 22, 24 in the left and right portions of the middle region. Left and right ends of the exit surface 22, 23, 24 in the middle region are substantially equal distance from the center O of the semiconductor light source 3 (the center O of the light emission surface 31 of the light-emitting chip 30).

(Description of Exit Surface 21 in the Upper Region)

Figure 10:
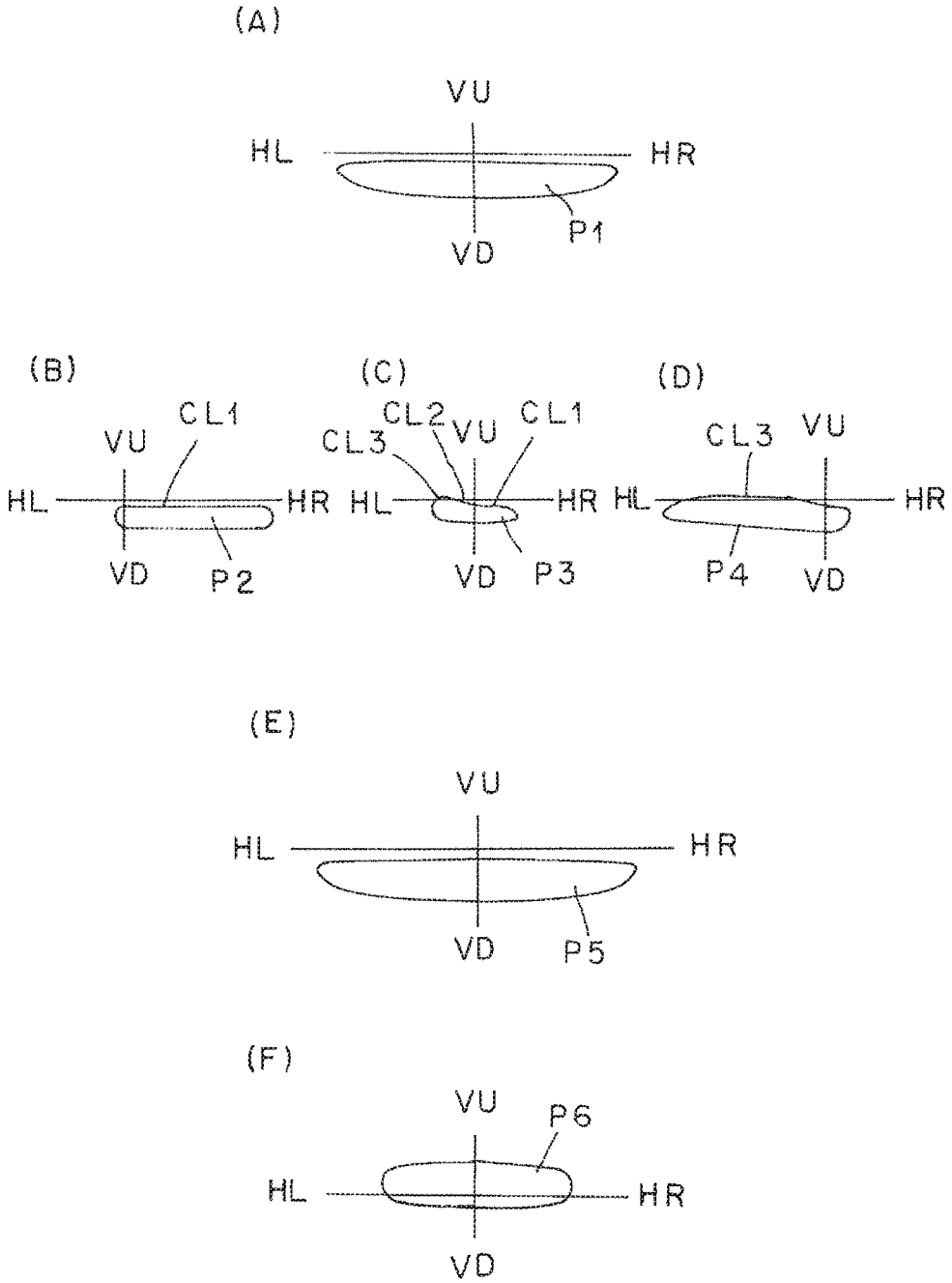
FIG. 10 are explanatory drawings showing a light distribution pattern formed by the first exit surface, the second exit surface, the third exit surface, the fourth exit surface, the fifth exit surface, and the auxiliary lens unit.

The exit surface 21 in the upper region emits a first light distribution pattern P1 (refer to FIG. 10 (A)) as a diffused light distribution pattern that is symmetrical or substantially symmetrical with respect to the vertical line VU-VD extending from the top to bottom of a screen.

Figure 4:
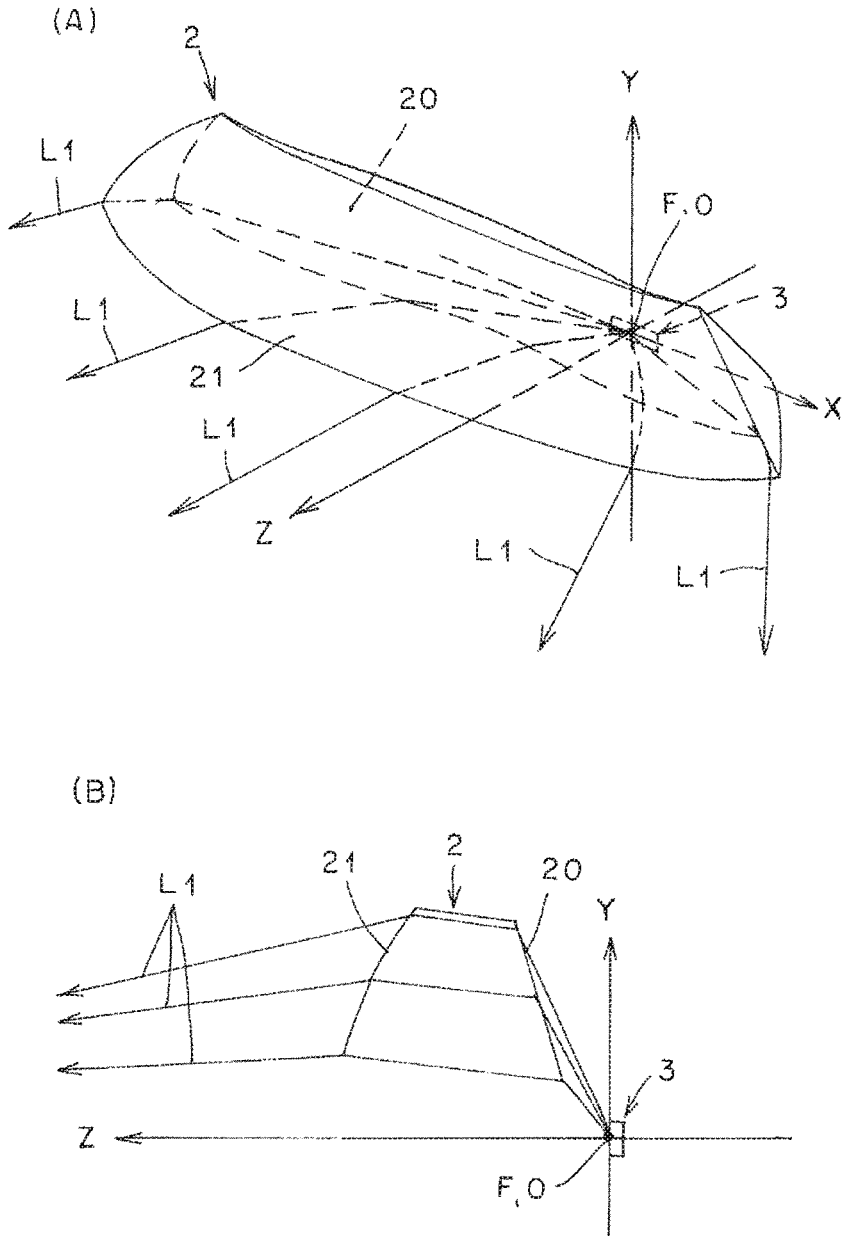
FIG. 4 are explanatory drawings showing an optical path in a first exit surface.

The exit surface 21 in the upper region, as shown in FIG. 4 (A), emits the light entered from the semiconductor light source 3 (the light emission surface 31) through the reference focus F as a focal point, that is, the incident light to the incident surface 20, to the left and right at a predetermined angle as exit light L1. The exit light L1 is, based on the reference optical axis Z, gradually increased in a left/right deflection angle as it goes to the left and right.

The exit surface 21 in the upper region, as shown in FIG. 4 (B), emits the light entered from the semiconductor light source 3 through the reference focus F as a focal point, that is, the incident light to the incident surface 20, up and down at a predetermined angle as exit light L1. The exit light L1 is, based on the reference optical axis Z, gradually increased in a lower deflection angle as it goes up. As a result, the exit light L1 nearest to the reference optical axis Z is distributed to the upper edge of the first light distribution pattern P1. The exit light L1 gradually going up from the reference optical axis Z is gradually distributed downward from the upper edge of the first light distribution pattern P1.

The exit surface 21 in the upper region emits the exit light L1 to an aiming position on the left, right, upper, and lower sides of the first light distribution pattern P1. The aiming position of the exit light L1 is symmetrical with respect to the Y-axis. As a result, the first light distribution pattern P1 is symmetrical or substantially symmetrical with respect to the vertical line VU-VD extending from the top to bottom of a screen. Further, the exit surface 21 in the upper region is composed of a curved surface symmetrical or substantially symmetrical with respect to the Y-axis.

(Description of Exit Surface 22 on the Right Side of the Middle Region)

The exit surface 22 on the right side of the middle region emits a second light distribution pattern P2 (refer to FIG. 10 (B)) as a diffused light distribution pattern having a right side lower horizontal cutoff line CL1.

Figure 5:
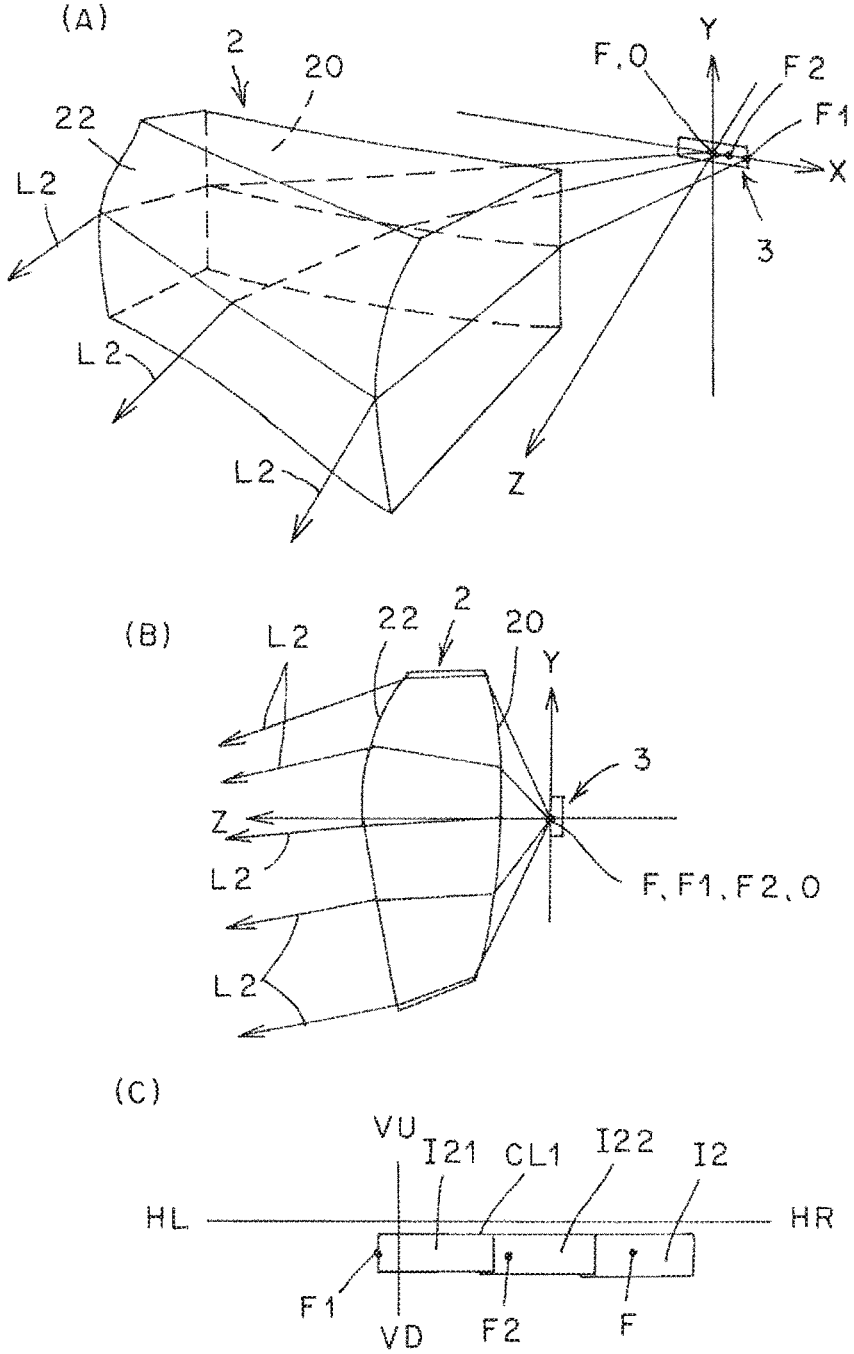
FIG. 5 are explanatory drawings showing an optical path in a second exit surface.

The exit surface 22 on the right side of the middle region, as shown in FIGS. 5 (A), (B), (C), takes a line segment, which is located on the X-axis of the semiconductor light source 3 (light emission surface 31) and extended from the reference focus F to the left end side or its vicinity of the semiconductor light source 3, as a focal line. In other words, the right end (periphery) of the exit surface 22 on the right side of the middle region takes the reference focus F as a focal point. The left end of the exit surface 22 on the right side of the middle region takes a point F1 on the left end side of the semiconductor light source 3 or on the X-axis in the vicinity thereof, as a focal point. The center of the exit surface 22 on the right side of the middle region takes a midpoint F2 between the reference focus F and the focal point F1 on the X-axis of the semiconductor light source 3, as a focal point.

The exit surface 22 on the right side of the middle region, as shown in FIG. 5 (A), emits the light from the semiconductor light source 3, that is, the incident light to the incident surface 20, to the left and right at a predetermined angle as exit light L2. The exit light L2 is, based on the left end of the exit surface 22 on the right side of the middle region, gradually increased in a right deflection angle as it goes to the right.

The exit light L2 from the left end of the exit surface 22 on the right side of the middle region is, as shown by a light emission surface image 121 in FIG. 5 (C), distributed to the left end of the second light distribution pattern P2. The exit light L2 from the right end of the exit surface 22 on the right side of the middle region is, as shown by a light emission surface image 12 in FIG. 5 (C), distributed to the right end of the second light distribution pattern P2. The exit light L2 from the center of the exit surface 22 on the right side of the middle region is, as shown by a light emission surface image 122 in FIG. 5 (C), distributed to the center of the second light distribution pattern P2.

The exit surface 22 on the right side of the middle region, as shown in FIG. 5 (B), exits the light entered from the semiconductor light source 3, that is, the incident light to the incident surface 20, up and down at a predetermined angle as exit light L2. The exit light L2 is, based on the reference optical axis Z, gradually increased in a lower deflection angle as it goes up and down. As a result, the exit light L2 nearest to the reference optical axis Z is gradually distributed to the upper edge of the second light distribution pattern P2, and takes the upper side of the light emission surface image 121, 122, 12 in FIG. 5 (C), as the lower horizontal cutoff line CL1. The exit light L2 gradually going up and down from the reference optical axis Z is gradually distributed downward from the lower horizontal cutoff line CL1 of the upper edge of the second light distribution pattern P2.

It is possible to precisely design the position of the left end of the second light distribution pattern P2 (the position of the left side of the light emission surface image 121 in FIG. 5 (C)) by setting the position of a focus at the left end of the exit surface 22 on the right side of the middle region to the point F1 on the left end side of the semiconductor light source 3 or on the X-axis in the vicinity thereof.

(Description of Exit Surface 23 in the Center of the Middle Region)

The exit surface 23 in the center of the middle region emits a third light distribution pattern P3 (refer to FIG. 10 (C)) as a condensed light distribution pattern having a right side lower horizontal cutoff line CL1, a center oblique cutoff line CL2, and a left side upper cutoff line CL3.

Figure 6:
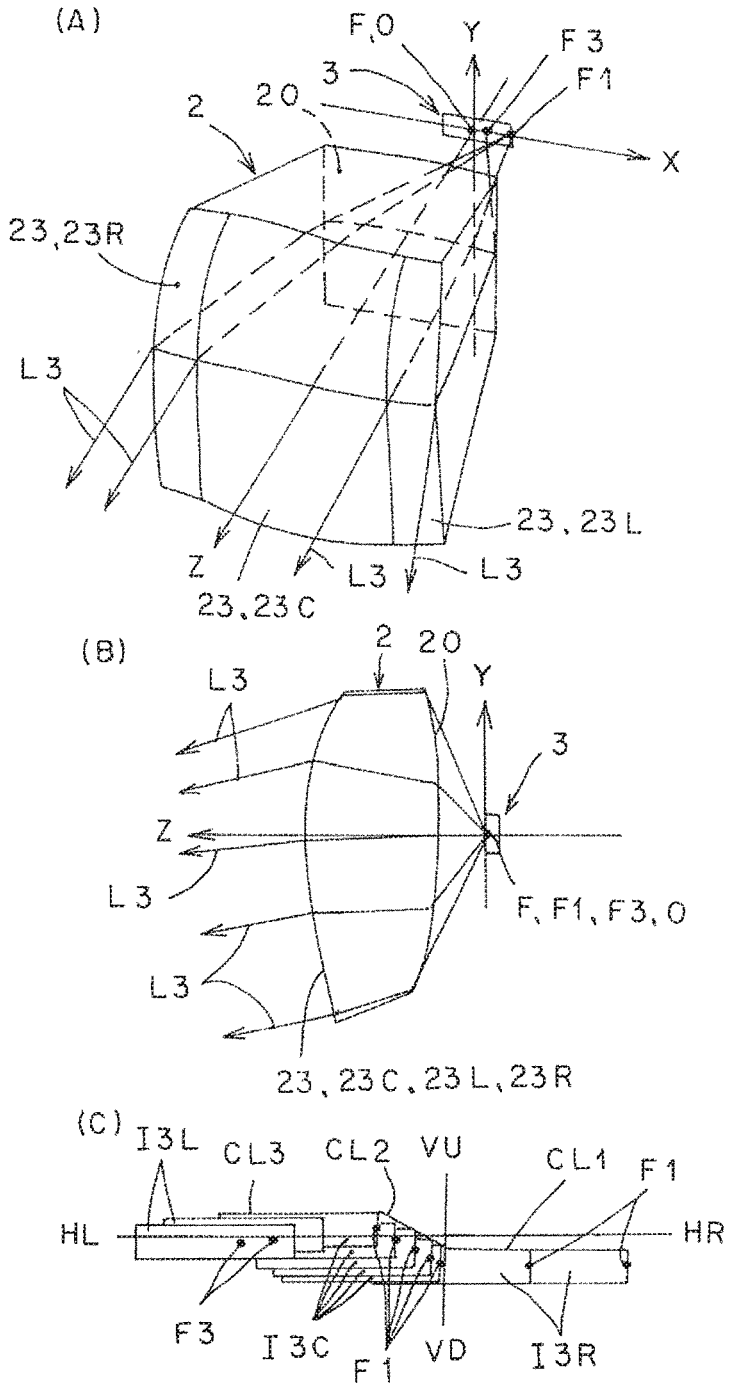
FIG. 6 are explanatory drawings showing an optical path in a third exit surface.

The exit surface 23 in the center of the middle region, as shown in FIGS. 6 (A), (B), (C), takes a line segment, which is located on the X-axis of the semiconductor light source 3 of the light emission surface 31 and extended from the left end side or its vicinity, of the semiconductor light source 3 to an arbitrary point between the reference focus F and the left end side or its vicinity of the semiconductor light source 3, as a focal line. In other words, portions 23R and 23C from the right end to the middle of the left end of the exit surface 23 in the center of the middle region take a point F1 on the left end side of the semiconductor light source 3 or on the X-axis in the vicinity thereof, as a focal point. The left end of the exit surface 23 in the center of the middle region takes an arbitrary point F3, which is located on the X-axis and between the reference focus F and the left end side of the semiconductor light source 3 or in the vicinity thereof, as a focal point. A portion 23L at the left end of the exit surface 23 in the center of the middle region takes a line segment between the focal point F1 at the left end and the arbitrary focal point F3, as a focal line (focal point).

The exit surface 23 in the center of the middle region, as shown in FIG. 6 (A), emits the light from the semiconductor light source 3, that is, the incident light to the incident surface 20, to the left and right at a predetermined angle as exit light L3. The exit light L3 is, based on the reference optical axis Z, gradually increased in a left/right deflection angle as it goes to the left and right.

The exit light L3 from the portion 23R at the right end of the exit surface 23 in the center of the middle region is, as shown by a light emission surface image I3R in FIG. 6 (C), distributed to the right end portion of the third light distribution pattern P3. The exit light L3 from the portion 23C at the right end of the exit surface 23 in the center of the middle region is, as shown by a light emission surface image I3C in FIG. 6 (C), distributed to the center portion of the third light distribution pattern P3. The exit light L3 from the portion 23L at the left end of the exit surface 23 in the center of the middle region is, as shown by a light emission surface image I3L in FIG. 6 (C), distributed to the left end portion of the third light distribution pattern P3.

The exit surface 23 in the center of the middle region, as shown in FIG. 6 (B), exits the light from the semiconductor light source 3, that is, the incident light to the incident surface 20, up and down at a predetermined angle as exit light L3. The exit light L3 is, based on the reference optical axis Z, gradually increased in a lower deflection angle as it goes up and down. As a result, the exit light L3 nearest to the reference optical axis Z is gradually distributed to the upper edge of the third light distribution pattern P3, and takes the upper sides of the light emission surface images I3R, I3C, I3L in FIG. 6 (C), as the lower horizontal cutoff line CL1, the oblique cutoff line CL2, and the upper horizontal cutoff line CL3. The exit light L3 gradually going up and down from the reference optical axis Z is gradually distributed downward from the lower horizontal cutoff line CL1, the oblique cutoff line CL2, and the upper horizontal cutoff line CL3 of the upper edge of the third light distribution pattern P3.

By setting a focal position in the portion 23R, 23C, which is from the right end to the halfway of the left end of the exit surface 23 in the center of the middle region, to the point F1 on the left end side of the semiconductor light source 3 or on the X-axis in the vicinity thereof, it is possible to precisely design the positions of the lower horizontal cutoff line CL1, the oblique cutoff line CL2, and the upper horizontal cutoff line CL3 of the third light distribution pattern P3 (the positions of the upper sides of the light emission surface image I3R and I3C in FIG. 6(C)).

(Description of Exit Surface 24 on the Left Side of the Middle Region)

The exit surface 24 on the left side of the middle region emits a fourth light distribution pattern P4 (refer to FIG. 10 (D)) as a diffused light distribution pattern having a left side lower horizontal cutoff line CL3.

Figure 7:
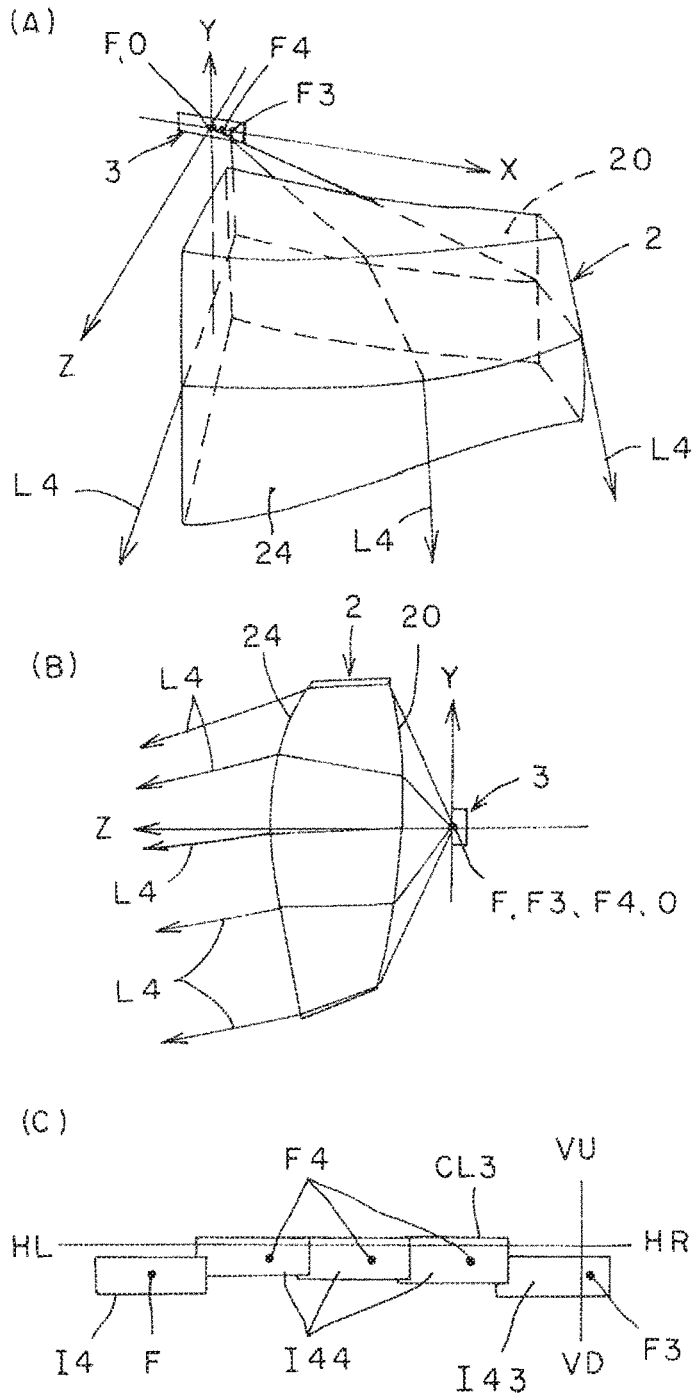
FIG. 7 are explanatory drawings showing an optical path in a fourth exit surface.

The exit surface 24 on the left side of the middle region, as shown in FIGS. 7 (A), (B), (C), takes a line segment, which is located on the X-axis of the semiconductor light source 3 (light emission surface 31) and extended from the reference focus F to the arbitrary focal point F3, as a focal line. In other words, the left end (periphery) of the exit surface 24 on the left side of the middle region takes the reference focus F as a focal point. The right end of the exit surface 24 on the left side of the middle region takes the arbitrary focal point F3 as a focus. The center of the exit surface 24 on the left side of the middle region takes a midpoint F4 between the reference focus F and the arbitrary focal point F3 on the X-axis of the semiconductor light source 3, as a focal point.

The exit surface 24 on the left side of the middle region, as shown in FIG. 7 (A), emits the light from the semiconductor light source 3, that is, the incident light to the incident surface 20, to the left and right at a predetermined angle as exit light L4. The exit light L4 is, based on the right end of the exit surface 24 on the left side of the middle region, gradually increased in a left deflection angle as it goes to the left.

The exit light L4 from the right end of the exit surface 24 in the center of the middle region is, as shown by a light emission surface image 143 in FIG. 7 (C), distributed to the right end of the fourth light distribution pattern P4. The exit light L4 from the left end of the exit surface 24 on the left side of the middle region is, as shown by a light emission surface image 14 in FIG. 7 (C), distributed to the left end of the fourth light distribution pattern P4. The exit light L4 from the center of the exit surface 24 on the left side of the middle region is, as shown by a light emission surface image 144 in FIG. 7 (C), distributed to the center of the fourth light distribution pattern P4.

The exit surface 24 on the left side of the middle region, as shown in FIG. 7 (B), exits the light entered from the semiconductor light source 3, that is, the incident light to the incident surface 20, up and down at a predetermined angle as exit light L4. The exit light L4 is, based on the reference optical axis Z, gradually increased in a lower deflection angle as it goes up and down. As a result, the exit light L4 nearest to the reference optical axis Z is gradually distributed to the upper edge of the fourth light distribution pattern P4, and takes the upper side of the light emission surface image 144 in FIG. 7 (C) as the upper horizontal cutoff line CL3. The exit light L4 gradually going up and down from the reference optical axis Z is gradually distributed downward from the upper horizontal cutoff line CL3 of the upper edge of the fourth light distribution pattern P4.

It is possible to smoothly connect the left end of the third distribution pattern P3 and the right end of the fourth light distribution pattern P4, by setting a focal position at the right end of the exit surface 24 on the left side of the middle region to the arbitrary focal point F3.

(Description of Exit Surface 25 in the Lower Region)

The exit surface 25 in the lower region emits a fifth light distribution pattern P5 (refer to FIG. 10 (E)) as a diffused light distribution pattern that is symmetrical or substantially symmetrical with respect to the vertical line VU-VD extending from the top to bottom of a screen.

Figure 8:
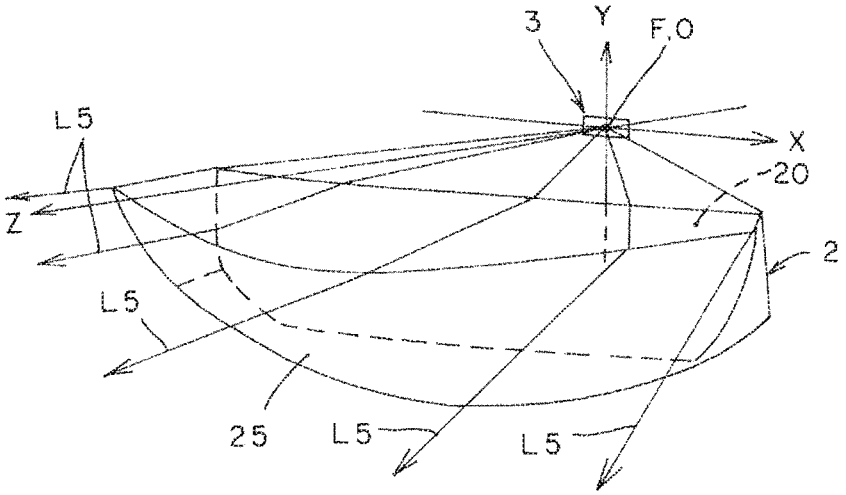
FIG. 8 are explanatory drawings showing an optical path in a fifth exit surface.
Figure 8:
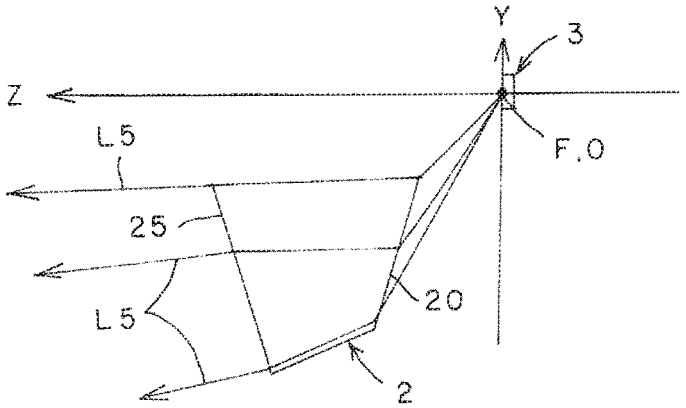
Figure 9:
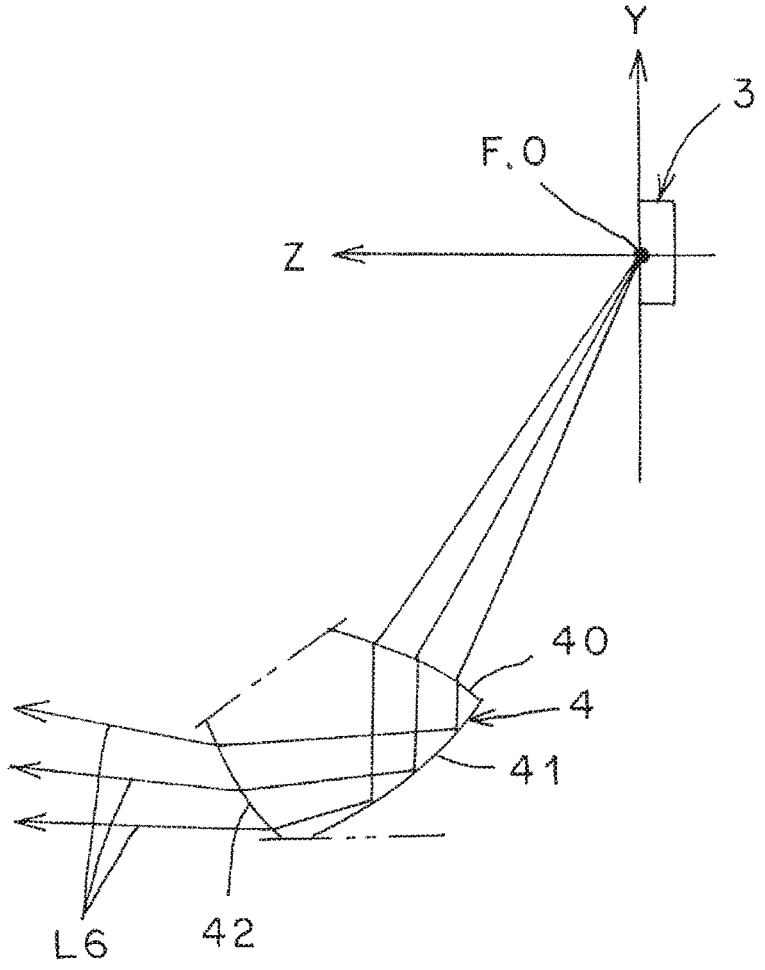
FIG. 9 is an explanatory drawing showing an optical path in an auxiliary lens unit.

The exit surface 25 in the lower region, as shown in FIG. 8 (A), emits the light entered from the semiconductor light source 3 (the light emission surface 31) through the reference focus F as a focal point, that is, the incident light to the incident surface 20 to the left and right at a predetermined angle as exit light L5. The exit light L5 is, based on the reference optical axis Z, gradually increased in a left/right deflection angle as it goes to the left and right.

The exit surface 25 in the lower region, as shown in FIG. 8 (B), emits the light entered from the semiconductor light source 3 through the reference focus F as a focal point, that is, the incident light to the incident surface 20 up and down at a predetermined angle exit light L5. The exit light L5 is, based on the reference optical axis Z, gradually increased in a lower deflection angle as it goes down. As a result, the exit light L5 nearest to the reference optical axis Z is distributed to the upper edge of the fifth light distribution pattern P5. The exit light L5 gradually going down from the reference optical axis Z is gradually distributed downward from the upper edge of the fifth light distribution pattern P5.

The exit surface 25 in the lower region emits the exit light L5 to an aiming position on the left, right, upper, and lower sides of the fifth light distribution pattern P5. The aiming position of the exit light L5 is symmetrical with respect to the Y-axis. As a result, the fifth light distribution pattern P5 is symmetrical or substantially symmetrical with respect to the vertical line VU-VD extending from the top to bottom of a screen. Further, the exit surface 25 in the lower region is composed of a curved surface symmetrical or substantially symmetrical with respect to the Y-axis.

(Description of Auxiliary Lens Unit 4)

An auxiliary lens unit 4 is provided integrally on the lower side of the lens 2. The auxiliary lens unit 4 is composed of an incident surface 40, a total reflection surface 41, and an exit surface 42. The auxiliary lens unit 4 enters the light emitted from the semiconductor light source 3 into the incident surface 40, totally reflects the incident light by the total reflection surface 41, emits the totally reflected light from the exit surface 42, and radiates the exit light L6 as an overhead sign light distribution pattern P6 shown in FIG. 10 (F), FIG. 11 (A), and FIG. 16 (A).

The overhead sign light distribution pattern P6 formed by the auxiliary lens 4 is an auxiliary light distribution pattern for a main light distribution pattern of a low beam light distribution pattern LP formed by the lens 2.

(Description of Flange Portion 5)

A flange portion 5 is provided integrally around the lens 2 and the auxiliary lens unit 4. The flange portion 5 is intended for attachment to the mounting member. The lens 2 and the auxiliary lens unit 4 are attached to the mounting member via the flange portion 5.

Description of Functions of the Embodiment

The vehicle lamp fitting 1L, 1R according to this embodiment are configured as described above. Hereinafter, the effects of the vehicle lamp fitting will be described.

When the semiconductor light source 3 is turned on, most of the light from the light emission surface 31 of the semiconductor light source 3 is refracted and entered into the lens 2 through an incident surface 20 of the lens 2. At this time, the incident light is subjected to light distribution control by the incident surface 20. The incident light is refracted and emitted to the outside from each of five exit surfaces 21 to 25 of the lens 2. At this time, the exit light is subjected to light distribution control by the exit surfaces 21 to 25. The exit light L1 to L5 is radiated forward of the vehicle C as five light distribution patterns P1 to P5.

In other words, the exit light L1 (refer to FIG. 4 (A), (B)) is emitted from the exit surface 21 in the upper region, and radiated forward of the vehicle C as a first light distribution pattern P1 shown in FIG. 10 (A). The exit light L2 (refer to FIG. 5 (A), (B)) is emitted from the exit surface 22 on the right side of the middle region, and radiated forward of the vehicle C as a second light distribution pattern P2 having a horizontal cutoff line CL1 shown in FIG. 10 (B). The exit light L3 (refer to FIG. 6 (A), (B)) is emitted from the exit surface 23 in the center of the middle region, and radiated forward of the vehicle C as a third light distribution pattern P3 having a horizontal cutoff line CL1, an oblique cutoff line CL2, and an upper horizontal cutoff line CL3 shown in FIG. 10 (C). The exit light L4 (refer to FIG. 7 (A), (B)) is emitted from the exit surface 24 on the left side of the middle region, and radiated forward of the vehicle C as a fourth light distribution pattern P4 having an upper horizontal cutoff line CL3 shown in FIG. 10 (D). The exit light L5 (refer to FIG. 8 (A), (B)) is emitted from the exit surface 25 in the lower region, and radiated forward of the vehicle C as a fifth light distribution pattern P5 shown in FIG. 10 (E).

Figure 11:
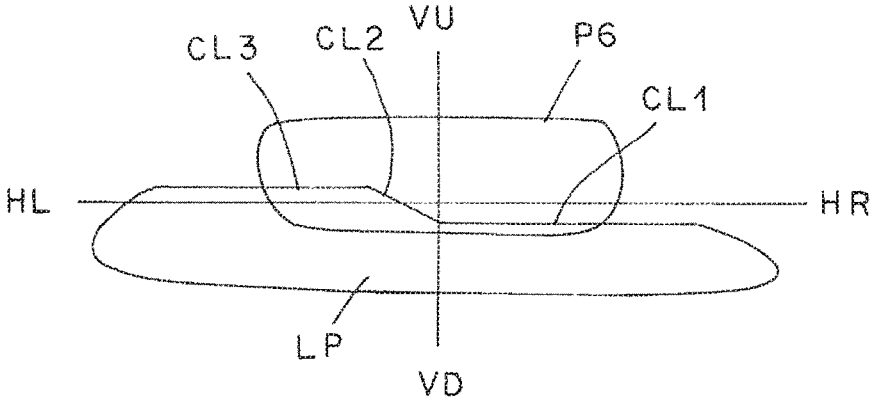
FIG. 11 are explanatory drawings showing a low beam light distribution pattern and an overhead sign light distribution pattern.
Figure 11:
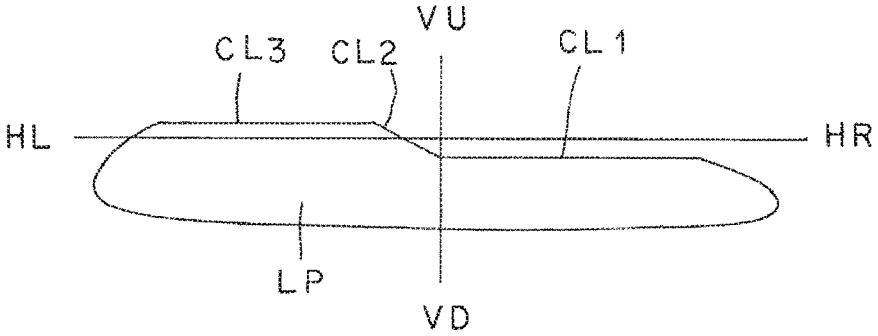
Figure 16:
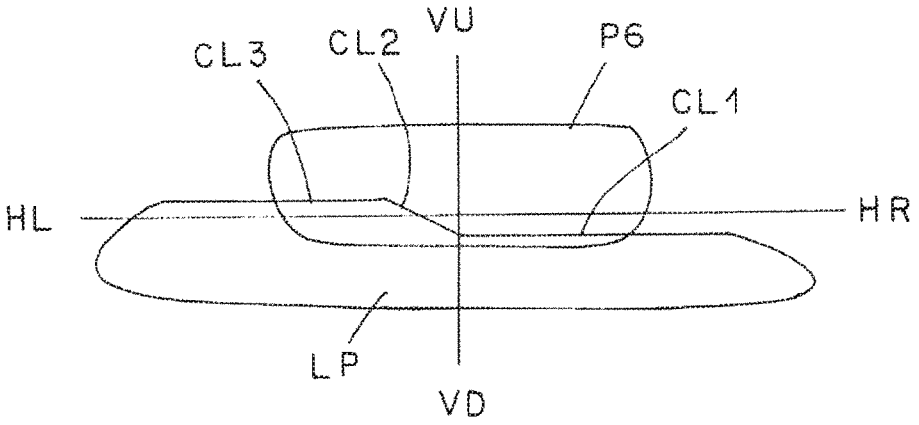
FIG. 16 are explanatory drawings showing a low beam light distribution pattern and an overhead sign light distribution pattern.
Figure 16:
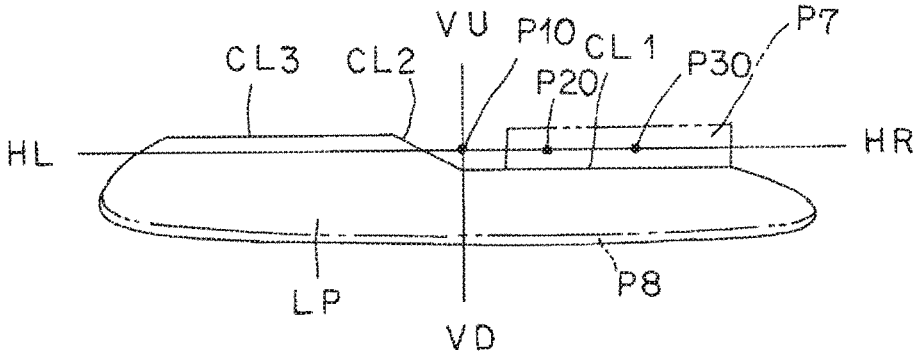

By superimposing the five light distribution patterns P1 to P5, a low beam light distribution pattern LP having the horizontal cutoff line CL1, the oblique cutoff line CL2, and the upper horizontal cutoff line CL3 shown in FIG. 11 (A), (B) and FIG. 16 (A), (B), is formed. Here, the upper edges of the first light distribution pattern P1 and the fifth light distribution pattern P5 are located lightly below the lower horizontal cutoff line CL1, the oblique cutoff line CL2, and the upper horizontal cutoff line CL3.

On the other hand, a part of the light from the semiconductor light source 3 is refracted and entered into the auxiliary lens 4 from the incident surface 40 of the auxiliary lens unit 4. At this time, the incident light is subjected to light distribution control by the incident surface 40. The incident light is totally reflected by the total reflection surface 41 of the auxiliary lens unit 4. At this time, the total reflected light is subjected to light distribution control by the reflection surface 41. The totally reflected light is refracted and emitted from the exit surface 42 of the auxiliary lens unit 4. At this time, the exit light L6 is subjected to light distribution control by the exit surface 42. The exit light L6 is radiated upper forward of the vehicle C as an overhead sign light distribution pattern P6 shown in FIG. 10 (F), FIG. 11 (A), and FIG. 16 (A).

Description of Effects of the Embodiment

The vehicle lamp fitting 1L, 1R according to the first embodiment has the configuration and functions described above. Hereinafter, the effects of the embodiment will be described.

In the vehicle lamp fitting 1L, 1R according to the embodiment, the focal point of the exit surface 21 in the upper region and the focal point of the exit surface 25 in the lower region are each located in the center O or substantially the center of the light emission surface 31 of the semiconductor light source 3, that is, the reference focus F. Thus, the exit surface 21 in the upper region and the exit surface 25 in the lower region are able to emit the exit light L1 and L5 to to an aiming position on the left, right, upper, and lower sides of the first light distribution pattern P1 and the fifth light distribution pattern P5. The aiming positions of the exit light L1 and L5 are symmetrical with respect to the Y-axis. As a result, the first light distribution pattern P1 and the fifth light distribution pattern P5 are symmetrical or substantially symmetrical with respect to the vertical line VU-VD extending from the top to bottom of a screen. Further, the exit surface 21 in the upper region and the exit surface 25 in the lower region are composed of a curved surface that is symmetrical or substantially symmetrical with respect to the Y-axis. Thus, the same lens 2 can be commonly used on the left and right sides. In other words, it is possible to use the same lens 2 for the lens 2 of the left side vehicle lamp fitting 1L mounted on the left side of the vehicle C and the right side vehicle lamp fitting 1R mounted on the right side of the vehicle C. Therefore, it is possible to achieve common appearance on the left and right sides of a vehicle. As a result, it is possible to reduce the manufacturing cost.

In the vehicle lamp fitting 1L, 1R according to the embodiment, the exit surface 21 in the upper region and the exit surface 25 in the lower region are comprised of one surface, and it is possible to connect the curved surfaces of the exit surface 21 in the upper region and the exit surface 25 in the lower region by a smooth curved surface. This can provide a smooth first light distribution pattern P1 and a smooth fifth light distribution pattern P5.

In the vehicle lamp fitting 1L, 1R according to the embodiment, the exit surface 22, 23, 24 in the middle region is divided into three portions in a front view by two vertical division step surfaces (vertical division lines) 2L and 2R that are substantially equal distance to the left and right of the center O of the semiconductor light source 3. Thus, it is easy to make the left and right vertical division step surfaces (vertical division lines) 2L and 2R symmetrical or substantially symmetrical. As a result, it is easy to design the left-right symmetry in the appearance of the lens 2.

In the vehicle lamp fitting 1L, 1R according to the embodiment, left and right ends of the exit surfaces 22, 23, 24 in the middle region are, in a front view, substantially equal distance from the center O of the semiconductor light source 3. Thus, it is easy to make the right end (periphery) of the exit surface 22 on the right side of the middle region and the left end (periphery) of the exit surface 24 on the left side of the middle region symmetrical or substantially symmetrical. As a result, it is easy to design the left-right symmetry in the appearance of the lens 2.

In the vehicle lamp fitting 1L, 1R according to the embodiment, the focus of the right end (periphery) of the exit surface 22 on the right side of the middle region and the focus of the left end (periphery) of the exit surface 24 on the left side of the middle region are located in the center O or substantially the center O of the light emission surface 31 of the semiconductor light source 3, that is, the reference focus F. Thus, it is easy to make the right end (periphery) of the exit surface 22 on the right side of the middle region and the left end (periphery) of the exit surface 24 on the left side of the middle region symmetrical or substantially symmetrical. As a result, it is easy to design the left-right symmetry in the appearance of the lens 2.

In the vehicle lamp fitting 1L, 1R according to the embodiment, the exit surface 22, 23, 24 in the middle region is divided into three portions on the left and right sides. The exit surface 22 on the right side of the middle region emits a second light distribution pattern P2 as a diffused light distribution pattern having a right side lower horizontal cutoff line CL1. The exit surface 23 in the center of the middle region emits a third light distribution pattern P3 as a condensed light distribution pattern having a right side lower horizontal cutoff line CL1, a center oblique cutoff line CL2, and a left side upper horizontal cutoff line CL3. The exit surface 24 on the left side of the middle region emits a fourth light distribution pattern P4 as a diffused light distribution pattern having a left side upper horizontal cutoff line CL3. As a result, it is possible to obtain an ideal low beam light distribution pattern LR.

Inside the vehicle lamp fitting 1L, 1R according to the embodiment, the portions 23R and 23C from the right end to the halfway of the left end of the exit surface 23 in the center of the middle region takes the point F1 on the left end side of the semiconductor light source 3 or on the X-axis in the vicinity thereof, as a focal point. Therefore, it is possible to precisely design the positions of the lower horizontal cutoff line CL1, the oblique cutoff line CL2, and the upper horizontal cutoff line CL3 of the third light distribution pattern P3 (the positions of the upper sides of the light emission surface images I3R and I3C in FIG. 6 (C)).

In the vehicle lamp fitting 1L, 1R according to the embodiment, the center O of the light emission surface 31 of the semiconductor light source 3 is located on the reference optical axis Z or in the vicinity thereof. Thus, it is possible to design the lens 2 while placing the center O of the semiconductor light source 3 on the reference optical axis Z. Therefore, by reversing the left and right of the exit surface in the middle region (the exit surface 22 on the right side of the middle region, the exit surface 23 in the center of the middle region, the exit surface 24 on the left side of middle region), it is possible to use the vehicle lamp fitting 1L, 1R for left-hand traffic as a vehicle lamp fitting for right-hand traffic. Further, it is unnecessary to distinguish the mounting member for mounting the semiconductor light source 3 and the heat sink member for the vehicle lamp fitting 1L, 1R for the left-hand traffic from those for right-hand traffic. As a result, it is possible to reduce the manufacturing cost.

Second Embodiment

Next, a vehicle lamp fitting according to a second embodiment of the invention will be described with reference to FIGS. 12 to 16. In FIGS. 12 to 16, a description will be omitted for the components denoted by the same reference numerals as those for the vehicle lamp fitting according to the first embodiment.

Figure 12:
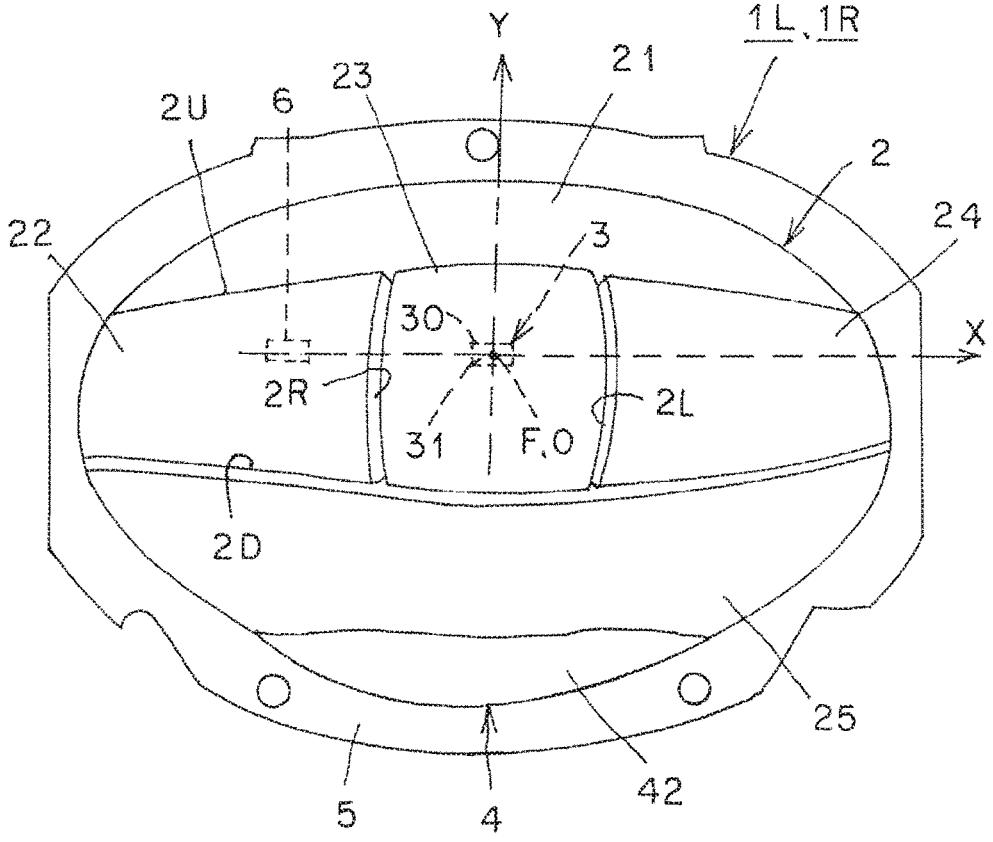
FIG. 12 is a front view of a lamp unit (lens) of a vehicle lamp fitting according to a second embodiment of the invention.

In the vehicle lamp fitting according to the second embodiment comprises a lens 2 and a semiconductor light source 3, as shown in FIG. 12. The lens 2 is composed of an incident surface 20, exit surfaces 21 to 25, and light diffusing units 6 and 60. The light diffusing units 6 and 60 are provided in a part of the incident surface 20, and are configured to diffuse a part of light distribution of a low beam light distribution pattern LP. As a result, the invention is capable of diffusing a part of light distribution of a low beam light distribution pattern LP.

In a conventional vehicle lamp fitting, it is impossible to arbitrarily diffuse an optional part of the distribution of a low beam.

Specifically, a conventional vehicle lamp fitting (for example, JP-A-2011-228196) is comprised of a light-emitting element and a projection lens, and is configured to diffuse and emit rays that are emitted from the light-emitting element and incident to the incident surface of the projection lens, to the left and right sides from the exit surface of the projection lens, and radiate it as a low beam. A conventional vehicle lamp fitting is configured to increase the visibility of a front side by reducing a brightness difference between a far side and a front side of a low beam by the entire exit surface.

However, in a conventional vehicle lamp fitting, it is possible to reduce a brightness difference between a far side and a front side of a low beam, but it is impossible to arbitrarily diffuse an optional part of the distribution of a low beam.

A problem to be solved by the second embodiment of the invention is that it is impossible, in a conventional vehicle lamp fitting, to arbitrarily diffuse light distribution of an optional part of light distribution of a low beam.

The vehicle lamp fitting according to the second embodiment comprises a lens, and a semiconductor light source. The lens is composed of an incident surface that enters light from the semiconductor light source into the lens, an exit surface that emits the incident light from the incident surface to the outside of the lens as a predetermined light distribution pattern, and a light diffusing unit that is provided in a part of the incident surface, and is configured to diffuse a part of light distribution of the light distribution pattern.

A configuration of the vehicle lamp fitting according to the second embodiment will be described in detail hereinafter.

(Description of First Light Diffusing Unit 6)

Figure 13:
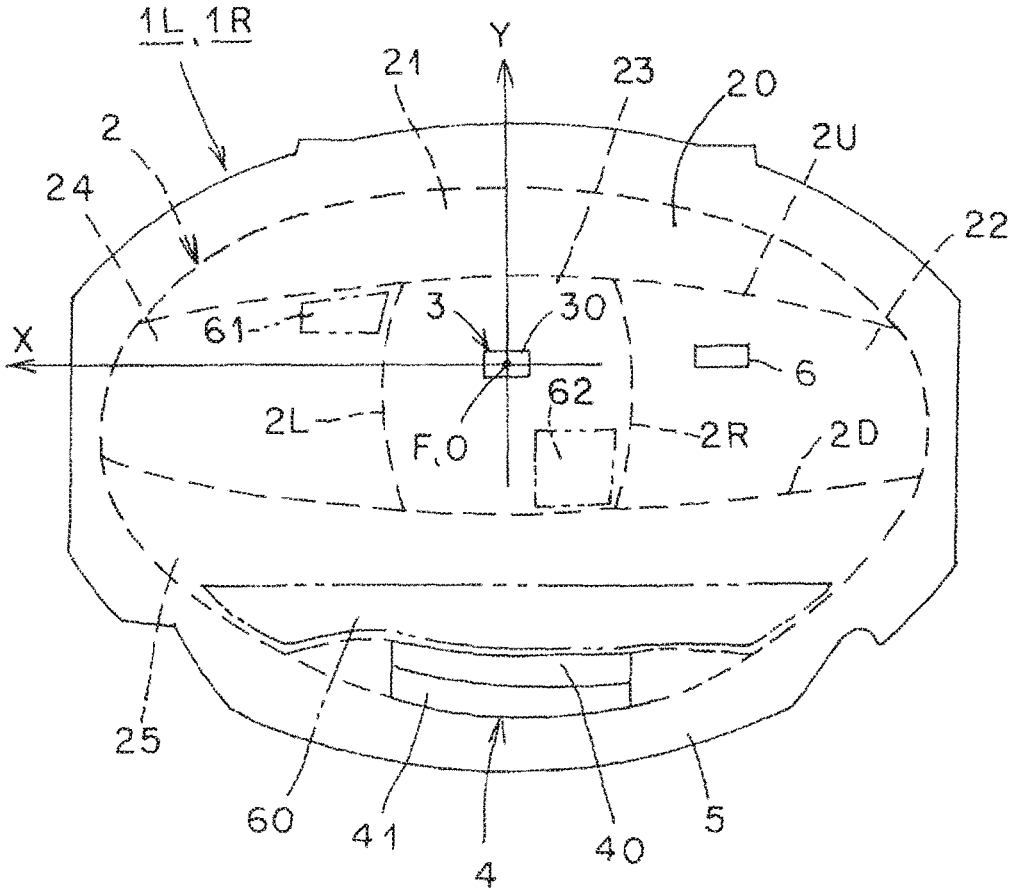
FIG. 13 is a rear view of a lamp unit (lens).
Figure 14:
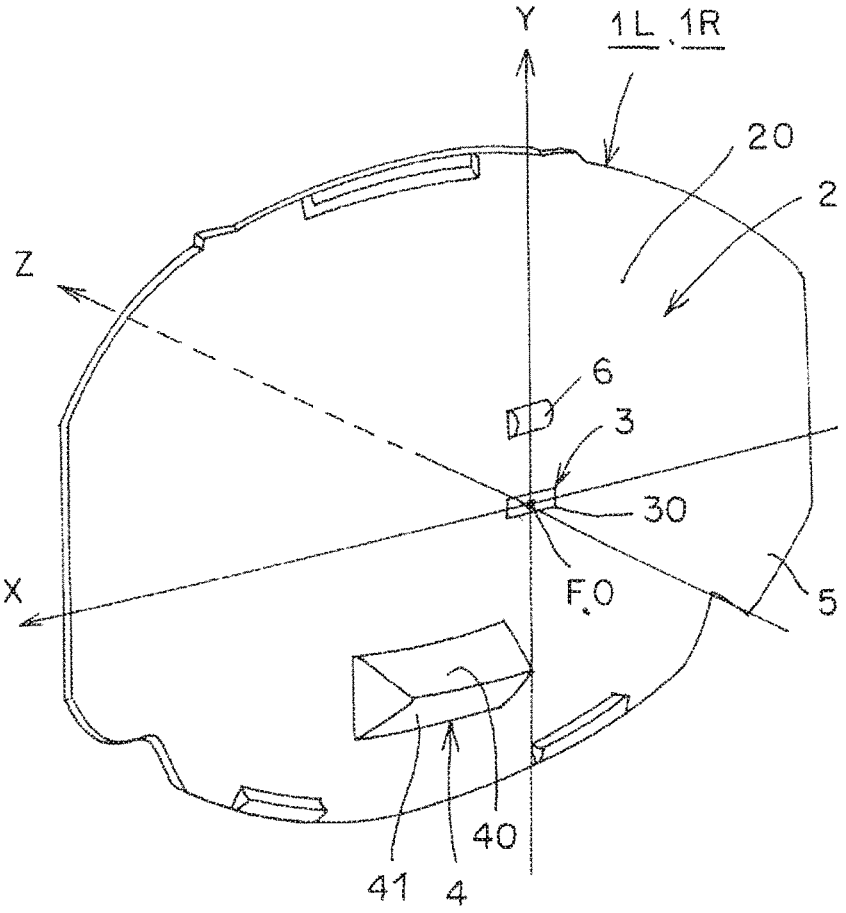
FIG. 14 is a rear perspective view of a lamp unit (lens).

As shown in FIGS. 12, 13, 14, a first light diffusing unit 6 is provided in the incident surface 20 of the lens 2, that is, on a horizontal line passing through the reference optical axis Z, that is, the X-axis, or in the vicinity thereof, in a part of the right side (opposite lane side).

The first light diffusing unit 6 is comprised of a semi-cylindrical shape prism (horizontal cylindrical prism, horizontal sickle prism, etc.) having a center line (center axis) parallel to or substantially parallel to the X-axis. The first light diffusing unit 6 is provided on the exit surface 22 on the right side of the middle region, that is, on a horizontal line passing through the reference optical axis Z, that is, the X-axis, or in the vicinity thereof, corresponding to a part of the right side (opposite lane side). The first light diffusing unit 6 may be a light diffusing unit other than a semi-cylindrical shape prism, for example, a microstructure.

Figure 15:
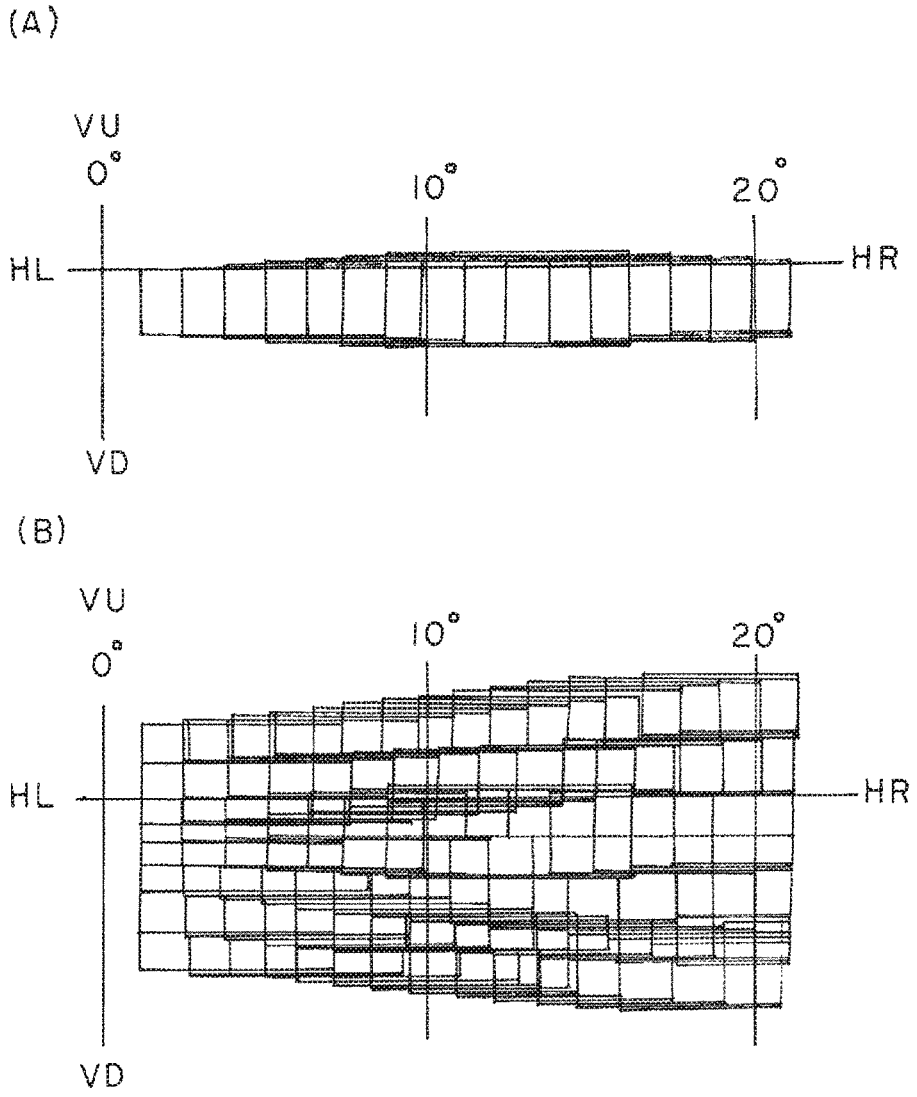
FIG. 15 shows explanatory drawings of a light emission surface image showing a diffused state of a part of light distribution.

A part of the exit surface 22 on the right side of the middle region corresponding to the first light diffusing unit 6 forms a part of the second light distribution pattern P2 having the right side lower horizontal cutoff line CL1 of the low beam light distribution pattern LP (refer to the light emission surface image in FIG. 15 (A)).

The first light diffusing unit 6 diffuses, as shown in FIG. 16 (B), a part of the second light distribution pattern P2 having the right side lower horizontal cutoff line CL1 of the low beam light distribution pattern LP (refer to the light emission image in FIG. 15 (A)) in a vertical or substantially vertical direction as a first diffused light distribution pattern P7 (refer to the light emission surface image in FIG. 15 (B)).

The first diffused light distribution pattern P7 is, as shown in FIG. 16 (B), radiated vertically across the lower horizontal cutoff line CL1 on the right side (opposite lane side) of the low beam light distribution pattern LP. Therefore, it is possible to satisfy a brightness range from a lower limit to an upper limit of the low beam light distribution pattern LP at a first point P10, a second point P20, and a third point P30 on a horizontal line HL-HR extending from the left to the right of a screen. The first light diffusing unit 60 diffuses light upward the lower horizontal cutoff line CL1 so that the light enters at a predetermined point.

(Description of Second Light Diffusing Unit 60)

As shown in FIG. 13, a second light diffusing unit 60 is provided in a part of the lower side of the incident surface 20 of the lens 2.

The second light diffusing unit 60 is comprised of a fisheye prism group. The second light diffusing unit 60 is provided corresponding to a part of the lower side of the exit surface 25 in the lower region. The second light diffusing unit 60 may be a light diffusing unit other than a fisheye prism group, for example, a microstructure.

A part of the lower side of the exit surface 25 in the lower region corresponding to the second light diffusing unit 60 forms a part of the lower side of a part of the fifth light distribution pattern P5.

The second light diffusing unit 60 diffuses, as shown in FIG. 16 (B), a part of the lower side of a part of the fifth light distribution pattern P5 in vertical and horizontal directions or substantially vertical and horizontal directions as a second diffused light distribution pattern P8.

The second diffused light distribution pattern P8 is, as shown in FIG. 16 (B), radiated to the lower side of the low beam light distribution pattern LP. Therefore, it is possible to eliminate a spectral color that occurs on the lower side of the low beam light distribution pattern LP (i.e. to mitigate a horizontal line of light).

(Description of Third Light Diffusing Unit 61)

As shown in FIG. 13, a third light diffusing unit 61 is provided in a part of the left side of the incident surface 20 of the lens 2. The third light diffusing unit 61 is comprised of a prism, a microstructure or the like.

A part in the upper right of the exit surface 24 on the left side of the middle region corresponding to the third light diffusing unit 61 forms a part of the fourth light distribution pattern P4. The third light diffusing unit 61 diffuses a part of the fourth light distribution pattern P4 in a vertical or substantially vertical direction (or downward). Therefore, it is possible to eliminate a spectral color that occurs on the upper horizontal cutoff line CL3 of the low beam light distribution pattern LP (i.e. to mitigate a horizontal line of light).

(Description of Fourth Light Diffusing Unit 62)

As shown in FIG. 13, a fourth light diffusing unit 62 is provided in a part of the center of the incident surface 20 of the lens 2. The fourth light diffusing unit 62 is comprised of a prism, a microstructure or the like.

A part in the lower right of the exit surface 23 in the center of the middle region corresponding to the fourth light diffusing unit 62 forms a part of the third light distribution pattern P3. The fourth light diffusing unit 62 diffuses a part of the third light distribution pattern P3 in a vertical or substantially vertical direction (or downward). Therefore, it is possible to eliminate a spectral color that occurs below the upper horizontal cutoff line CL1 of the low beam light distribution pattern LP (i.e. to mitigate a horizontal line of light).

Description of Effects of the Embodiment

The vehicle lamp fitting 1L, 1R according to the second embodiment has the configuration and functions described above. Hereinafter, the effects of this embodiment will be described.

The vehicle lamp fitting 1L, 1R according to this embodiment is able to arbitrarily diffuse a part of light distribution of a low beam light distribution pattern LP by a first light diffusing unit 6 and a second light diffusing unit 60, which are provided in a part of the incident surface 20 of the lens 2.

In particular, the vehicle lamp fitting 1L, 1R according to this embodiment enters light (direct light) from the semiconductor light source 3 into the lens 2 through the incident surface 20 of the lens 2, and radiates the incident light to the outside from the exit surfaces 21 to 25 of the lens 2 as a predetermined light distribution pattern, a low beam light distribution pattern LP in this example. Thus, it is possible to arbitrarily diffuse a part of light distribution of a low beam light distribution pattern LP by a first light diffusing unit 6, a second light diffusing unit 60, a third light diffusing unit 61, and a fourth light diffusing unit 62, which are provided in a part of the incident surface 20 of the lens 2.

Here, a projector type vehicle lamp fitting will be described. Even when a light diffusing unit is provided on an incident surface of a projector type lens of the vehicle lamp fitting, the light diffusing unit diffuses an entire light distribution pattern. Thus, a projector type vehicle lamp fitting is not able to diffuse a part of the light distribution pattern. On the other hand, the vehicle lamp fitting 1L, 1R according to this embodiment is a lens direct type, and is able to diffuse a part of the light distribution pattern.

In the vehicle lamp fitting 1L, 1R according to this embodiment, the first light diffusing unit 6 diffuses, as shown in FIG. 16 (B), a part of the second light distribution pattern P2 having a right side lower horizontal cutoff line CL1 (refer to the light emission image in FIG. 15 (A)) in a vertical or substantially vertical direction as a first diffused light distribution pattern P7 (refer to the light emission surface image in FIG. 15 (B)).

By superimposing five light distribution patterns P1 to P5, a low beam light distribution pattern LP having a horizontal cutoff line CL1, an oblique cutoff line CL2, and an upper horizontal cutoff line CL3 shown in FIG. 16 (A), (B) is formed.

The first diffused light distribution pattern P7 is, as shown in FIG. 16 (B), radiated vertically across the lower horizontal cutoff line CL1 on the right side (opposite lane side) of the low beam light distribution pattern LP. Therefore, it is possible to satisfy a brightness range from a lower limit to an upper limit of the low beam light distribution pattern LP at a first point P10, a second point P20, and a third point P30 on a horizontal line HL-HR extending from the left to right of a screen. As a result, it is possible to obtain a satisfactory low beam light distribution pattern LP.

In the vehicle lamp fitting 1L, 1R according to this embodiment, the second light diffusing unit 60 is able to diffuse, as shown in FIG. 16 (B), a part of the lower side of a part of the fifth light distribution pattern P5 in vertical and horizontal directions or substantially vertical and horizontal directions as a second diffused light distribution pattern P8.

The second diffused light distribution pattern P8 is, as shown in FIG. 16 (B), radiated to the lower side of the low beam light distribution pattern LP. Therefore, it is possible to eliminate a spectral color that occurs below the low beam light distribution pattern LP (i.e. to mitigate a horizontal line of light). As a result, it is possible to obtain a satisfactory low beam light distribution pattern LP.

In the vehicle lamp fitting 1L, 1R according to this embodiment, an exit surface is divided into a plurality of parts, five exit surface 21 to 25 in this example, and the light diffusing units 6, 60, 61, 62 are provided in a range corresponding to the divided exit surfaces 21 to 25 of the incident surface 20. In other words, the light diffusing units, 6, 60, 61, 62 do not cross two horizontal division step surfaces 2U, 2D and two vertical division step surfaces 2L, 2R. Therefore, the light diffused by the light diffusing units 6, 60, 61, 62 is not emitted from two horizontal division step surfaces 2U, 2D and two vertical division step surfaces 2L, 2R, and the diffused light can be securely subjected to light distribution control.

Description of Examples Other than the Embodiments

In the first and second embodiments, a vehicle headlight and a low beam headlamp have been described. However, in the present invention, a vehicle lamp fitting may be other than a vehicle headlight and a low beam headlamp, for example, a fog lamp and a high beam headlamp.

In the first embodiment, the exit surface 22, 23, 24 in the middle region is divided into three portions. However, in the present invention, the exit surface in the middle region may be one portion, not divided, or may be divided into two, four or more portions. In this case, when the number of exit surfaces increases, light distribution control becomes easy, but loss of light from the semiconductor light source 3 increases. Further, when the number of exit surfaces decreases, loss of light from the semiconductor light source 3 decreases, but light distribution control becomes difficult. Therefore, the number of exit surfaces is adjusted considering the balance between the light distribution control and the loss of light from the semiconductor light source 3.

Further, in the first and second embodiments, the auxiliary lens unit 4 is provided on the lower side of the lens 2 to form the overhead sign light distribution pattern P6. However, in the present invention, an auxiliary lens unit may be provided around the lens 2 to form an auxiliary light distribution pattern other than the overhead sign light distribution pattern P6. Further, a plurality of auxiliary lens units may be provided to form a plurality of auxiliary light distribution patterns. Furthermore, an auxiliary lens unit may not be provided, and an auxiliary light distribution pattern may not be formed.

Still further, in the first and second embodiments, the exit surface 22, 23, 24 in the middle region is divided into three portions, left side (driving lane side), center, and right side (opposite lane side), by two vertical division step surfaces (vertical division line) 2L, 2R. However, in the present invention, the exit surface in the middle region may be divided into a plurality of portions, five or more, by the plural, four or more vertical division step surfaces (vertical division line).

Moreover, in the second embodiment, a light diffusing unit is the first light diffusing unit 6 comprised of a semi-cylindrical shape prism having a center line parallel to the X-axis, and the second light diffusing unit 60 comprised of a fisheye prism group. However, in the present invention, a light diffusing unit may be a prism other than a semi-cylindrical shape prism having a center line parallel to the X-axis and a fisheye prism group. For example, a semi-cylindrical shape prism having a center line parallel to the Y-axis (in this case, light is diffused in a horizontal direction), or a semi-cylindrical shape prism having an oblique center line (in this case, light is diffused in a direction orthogonal to a center line).

Still further, in the second embodiment, the first light diffusing unit 6, the second light diffusing unit 60, the third light diffusing unit 61, and the fourth light diffusing unit 62 are provided in a part of the incident surface 20 of the lens 2. However, in the present invention, a light incident surface other than the first light diffusing unit 6, the second light diffusing unit 60, the third light diffusing unit 61, and the fourth light diffusing unit 62 may be provided in a part of the incident surface 20 of the lens 2, thereby arbitrarily diffusing a part of light distribution of a light distribution pattern. Further, in the second embodiment, the exit surface 21 to 25 is divided into five portions. However, in the present invention, the exit surface may be one surface without dividing.

Although the present invention has been fully described hereinbefore in connection with the preferred embodiments, it is apparent to those skilled in the art that the invention is not limited to the described embodiments. The invention may be modified and embodied in other specific forms without departing from its spirits and scope defined by the appended claims. Therefore, the description of this specification is for the purpose of illustration and not intended to have any restrictive meaning to the invention.

The entire contents of Japanese Patent Application No. 2013-134164 (Jun. 26, 2013 filed) and Japanese Patent Application No. 2013-134165 (Jun. 26, 2013 filed) are incorporated herein by reference.

INDUSTRIAL APPLICABILITY

It is possible to provide a lens direct type vehicle lamp fitting, which enters light (direct light) from a semiconductor light source, and emits a predetermined light distribution pattern.

DESCRIPTION OF REFERENCE NUMERALS

1L, 1T Vehicle lamp fitting
2 Lens
20 Incident surface
21, 22, 23, 24, 25 Exit surface
2L, 2R Vertical division step surface
2U, 2D Horizontal division step surface
3 Semiconductor light source
30 Light-emitting chip
31 Light emission surface
4 Auxiliary lens unit
40 Incident surface
41 Total reflection surface
42 Exit surface
5 Flange portion
6 First light diffusing unit
60 Second light diffusing unit
C Vehicle
CL1 Lower horizontal cutoff line
CL2 Oblique cutoff line
CL3 Upper horizontal cutoff line
F Reference focus
F1, F2, F3, F4 Focal point
HL-HR Horizontal line extending from the left to right of a screen
12, 121, 122, I3C, 13L, 13R, 14, 143, 144 Light emission surface image
LP Low beam light distribution pattern
O Center
P1 First light distribution pattern
P2 Second light distribution pattern
P3 Third light distribution pattern
P4 Fourth light distribution pattern
P5 Fifth light distribution pattern
P6 Overhead sign light distribution pattern
P10 First point
P20 Second point
P30 Third point
VU-VD Vertical line extending from the top to bottom of a screen
X X-axis
Y Y-axis
Z Reference optical axis (Z-axis)

The invention claimed is:

1. A vehicle lamp fitting, comprising a lens and a semiconductor light source, wherein:

the lens comprises an incident surface, and an exit surface that comprises an upper exit surface, a middle exit surface, and a lower exit surface, which are divided from each other by a horizontal step surface which does not intersect a reference optical axis of the semiconductor light source and is provided between the upper exit surface and middle exit surface and between the middle exit surface and the lower exit surface, and the upper exit surface is comprised of one surface and the lower exit surface is comprised of one surface different from the upper exit surface, and the upper exit surface and the lower exit surface have a focal point located at the center or substantially the center of a light emission surface of the semiconductor light source, the middle exit surface is, in a front view, divided by at least two vertical step surfaces substantially equal distance to the left and right from the center of the semiconductor light source without intersecting the reference optical axis of the semiconductor light source, wherein each of divided exit surfaces of the middle exit surface is arranged to take, as focal line, a different line segment which is located on the light emission surface, and the focal lines of the divided exit surfaces, located respectively on both end sides in a horizontal direction among the divided exit surfaces of the middle exit surface, each include the focal point of the upper exit surface and the lower exit surface.

2. The vehicle lamp fitting according to claim 1, wherein a left end and a right end of the middle exit surface are, in a front view, substantially equal distance from the center of the semiconductor light source.

3. The vehicle lamp fitting according to claim 1, wherein:

the divided exit surfaces of the middle exit surface include an opposite lane side, a center, and a driving lane side, the divided exit surface of the opposite lane side exit surface emits an opposite lane side diffused light distribution pattern, the divided exit surface of the center exit surface emits a central condensed light distribution pattern, and the divided exit surface of the driving lane side exit surface emits a driving lane side diffused light distribution pattern.

4. The vehicle lamp fitting according to claim 1, wherein a center of the light emission surface of the semiconductor light source is located on the reference optical axis or in the vicinity thereof.

5. The vehicle lamp fitting according to claim 1, wherein the lens is provided with a light diffusing unit formed on a part of the incident surface to diffuse a part of light distribution to be emitted from the exit surface.

6. The vehicle lamp fitting according to claim 1, wherein the middle exit surface includes a center region, and the reference optical axis of the semiconductor light source passes through a center of the center region.

7. The vehicle lamp fitting according to claim 1, wherein the horizontal step surface is arranged such that the upper exit surface is recessed rearward from the middle exit surface, and the middle exit surface is recessed rearward from the lower exit surface.

8. The vehicle lamp fitting according to claim 3, wherein the vertical step surface is arranged such that the divided exit surface of the center is recessed rearward from the divided exit surfaces respectively of the opposite lane side and the driving lane side.

* * * * *